US009095211B2

(12) United States Patent
Amann et al.

(10) Patent No.: US 9,095,211 B2
(45) Date of Patent: Aug. 4, 2015

(54) DEVICE FOR RELEASABLY CONNECTING A FURNITURE PULL-OUT, WHICH IS MOVABLE GUIDED IN A FURNITURE CARCASS VIA A GUIDANCE UNIT TO SAID GUIDANCE UNIT

(75) Inventors: Jurgen Amann, Lustenau (AT); Gunter Grabher, Fussach (AT)

(73) Assignee: GRASS GMBH, Hochst (AT)

( * ) Notice: Subject to any disclaimer, the term of this patent is extended or adjusted under 35 U.S.C. 154(b) by 0 days.

(21) Appl. No.: 14/238,318

(22) PCT Filed: Aug. 16, 2012

(86) PCT No.: PCT/EP2012/003482

§ 371 (c)(1),
(2), (4) Date: Feb. 11, 2014

(87) PCT Pub. No.: WO2013/023783

PCT Pub. Date: Feb. 21, 2013

(65) Prior Publication Data

US 2014/0210330 A1 Jul. 31, 2014

(30) Foreign Application Priority Data

Aug. 18, 2011 (DE) ..... 20 2011 104 673 U

(51) Int. Cl.
*A47B 88/00* (2006.01)
*A47B 88/04* (2006.01)

(52) U.S. Cl.
CPC ..... *A47B 88/0422* (2013.01); *A47B 2088/0429* (2013.01)

(58) Field of Classification Search
CPC ..... A47B 88/0422; A47B 2088/0429
USPC ..... 312/334.4, 334.5, 334.6, 330.1, 334.27, 312/334.32, 351; 384/22
See application file for complete search history.

(56) References Cited

U.S. PATENT DOCUMENTS 5,261,737 A * 11/1993 Faust et al. ..... 312/334.46
5,302,016 A * 4/1994 Lautenschlager et al. .... 312/333

(Continued)

FOREIGN PATENT DOCUMENTS

CN 1432323 7/2003
DE 8802690 5/1988

(Continued)

*Primary Examiner* — Hanh V Tran
(74) *Attorney, Agent, or Firm* — Hoffmann & Baron, LLP

(57) ABSTRACT

In a device for releasably connecting a furniture pullout part movably guided in a furniture carcass by a guide unit to the guide unit, the device including a device housing on which a control element is integrally formed and pivotably mounted via at least one solid body joint in such a way that the connection between the furniture pullout part and the guide unit can be released on actuation of the control element, at a distance from the solid body joint, supporting surfaces are provided for supporting the control element while preventing a relative movement between this and the device housing.

10 Claims, 2 Drawing Sheets

(56) References Cited

U.S. PATENT DOCUMENTS

| | | | | |
|---|---|---|---|---|
| 5,439,283 | A | 8/1995 | Schroder et al. | |
| 5,580,139 | A * | 12/1996 | Grabher | 312/333 |
| 5,588,729 | A * | 12/1996 | Berger | 312/334.4 |
| 7,549,712 | B2 * | 6/2009 | Booker et al. | 312/334.6 |
| 2002/0158557 | A1 * | 10/2002 | Weichelt | 312/334.4 |
| 2003/0234603 | A1 * | 12/2003 | Salice | 312/334.5 |
| 2004/0095047 | A1 * | 5/2004 | Salice | 312/332.1 |
| 2004/0239219 | A1 * | 12/2004 | Kim et al. | 312/334.4 |
| 2008/0218045 | A1 * | 9/2008 | Moser | 312/333 |
| 2009/0236959 | A1 * | 9/2009 | Liang et al. | 312/334.4 |
| 2009/0251037 | A1 * | 10/2009 | Berger | 312/334.1 |
| 2009/0261700 | A1 * | 10/2009 | Chen et al. | 312/334.46 |
| 2012/0292465 | A1 * | 11/2012 | Holzer et al. | 248/201 |

FOREIGN PATENT DOCUMENTS

| | | |
|---|---|---|
| DE | 4432820 | 3/1996 |
| DE | 20107278 | 9/2001 |
| DE | 20217545 | 2/2003 |
| DE | 202009003886 | 7/2009 |
| EP | 0695523 | 2/1998 |
| WO | WO 2010/040273 | 4/2010 |

* cited by examiner

DEVICE FOR RELEASABLY CONNECTING A FURNITURE PULL-OUT, WHICH IS MOVABLE GUIDED IN A FURNITURE CARCASS VIA A GUIDANCE UNIT TO SAID GUIDANCE UNIT

This application claims priority based on an International Application filed under the Patent Cooperation Treaty, PCT/EP2012/003482, filed Aug. 16, 2012, which claims priority to DE202011104673.0, filed Aug. 18, 2011.

BACKGROUND OF THE INVENTION

The invention relates to a device for releasably connecting a furniture pullout part movably guided in a furniture carcass by means of a guide unit to the guide unit, the device comprising a device housing on which a control element is integrally formed and pivotably mounted via at least one solid body joint in such a way that the connection between the furniture pullout part and the guide unit can be released on actuation of the control element.

A device of this kind is for example known from EP 0 695 523 B1. Such devices are used for coupling the guide unit to a furniture pullout part, so that the furniture pullout part, for example a drawer, can be separated from the guide unit if required. It can now be taken out of the furniture carcass, making it possible to install the guide unit permanently into the carcass. The device known from prior art is a single-piece moulding made of a flexible plastic material. A control element is injection-moulded to a base section of the moulding. The control element comprises a handle and, integral with the handle, a latching section with a latching hook. By operating the handle, the control element, which is connected to the base section of the moulding via a solid body joint, can be pivoted; in this process, the latching hook disengages from a complementary latching section on the guide unit, so that the furniture pullout part can be separated from the guide unit.

A furniture pullout part is subjected to not inconsiderable forces, in particular in the opening and closing process and in particular if the furniture pullout part is heavily loaded. Peripheral parts of the furniture pullout part, such as the above-mentioned device in particular, can be subjected to heavy loads. Plastic control elements, for example, are at risk of material breakage. This is for example simulated in a dynamic "opening with overload" stop test. In this test, the furniture pullout part is brought from the closed position into an opened position using full force in order to test the stability of individual components. This dynamic test imposes a very heavy load on the material, resulting in repeated breakages caused by peak loads.

SUMMARY OF THE INVENTION

The invention is based on the problem of creating a device of the type referred to above, the components of which have a long service life even if heavily loaded.

This problem is solved by a device with the features of the independent claim 1. Further developments of the invention are described in the dependent claims.

The device according to the invention is characterised in that, at a distance from the solid body joint or the film hinge, supporting means are provided for supporting the control element while preventing a relative movement between this and the device housing.

The supporting element provides a support for the control element, resulting in minimum deformation of the control element even at high loads. The dynamic "opening with overload" stop test can be performed on the device according to the invention without resulting in material breakage. As a whole, the device has a long service life, so that a replacement of such devices because of damage is required only very rarely if at all. This reduces overall costs. The supporting means are of course arranged such that the operation of the control element, i.e. the release of the furniture pullout part from the guide unit, is not impeded.

In a further development of the invention, the supporting means are designed such that the control element can be supported in the X and Y spatial directions as well as the Z spatial direction of a Cartesian coordinate system defined by X, Y and Z coordinates. This means that the supporting means can provide support in all three spatial directions, making the direction in which forces act irrelevant.

In a further development of the invention, the supporting means have complementary supporting surfaces on the device housing on the one hand and on the control element on the other hand.

The supporting surfaces can be represented by supporting projections which project from the periphery of the device housing and/or from the periphery of the control element. The supporting projections are expediently formed integrally when producing the housing and the control element. Alternatively, the complementary supporting surfaces on the device housing and on the control element could be chosen such that no separate projections are provided, but surfaces present at the production of the housing and the control element are used; these will then have to be matched to one another in such a way that they are complementary on the one hand and are close to or in contact with one another on the other hand, so that a reliable support can be provided under the action of forces.

In a further development of the invention, the control element is designed in the manner of a lever, with a manually operated operating section, which is located on the near side of the solid body joint, and with an engagement section for engagement with the complementary engagement means on the guide unit, which is located on the other side of the solid body joint.

In order to obtain a firm hold of the engagement section on the control element side and of the complementary engagement means when in engagement and at the same time to ensure that the engagement section can easily be released from the engagement means, the engagement section and the engagement means comprise latching means. The release of the furniture pullout part from the guide unit is achieved simply by unlatching the latching means formed on the engagement section from the complementary latching means of the guide unit. The latching means are expediently represented by latching teeth.

In a further development of the invention, and adjusting unit is provided for the vertical adjustment of the furniture pullout part relative to the guide unit. In this way, the gap between the furniture pullout part and the surrounding furniture carcass can be adjusted in the vertical direction.

In a particularly preferred embodiment, the adjusting unit comprises a wedge-shaped adjusting member which projects into the gap between the underside of the furniture pullout part and the guide unit and the adjusting movement of which causes a raising or lowering of the furniture pullout part relative to the guide unit.

In a particularly preferred embodiment, the adjusting member is pivotably mounted on the device housing by way of a pivot bearing having a journal pin. The vertical adjustment is therefore obtained by pivoting the adjusting member in one or the other direction.

In a particularly preferred embodiment, the journal pin is a part of the supporting means for the control element. The journal pin is therefore multifunctional, serving as a supporting means in addition to being part of the pivot bearing.

In a further development of the invention, the device housing and the control element are made of a plastic material. In particular, the same plastic material is used for the device housing and the control element.

In a particularly preferred embodiment, the device housing and the control element are injection-moulded plastic parts, the control element being injection-moulded to the device housing in the production process. Alternatively, the device housing and the control element could conceivably be produced in a two-component injection moulding process; in this case, the housing and the control element would be made of different plastic materials.

The invention further includes a piece of furniture with a furniture pullout part which is movable relative to a furniture carcass and guided by way of a guide unit, and which is characterised by a device according to any of claims 1 to 12.

BRIEF DESCRIPTION OF THE DRAWINGS

A preferred embodiment of the invention is illustrated in the drawing and explained in greater detail below. Of the drawing.

DETAILED DESCRIPTION OF THE PREFERRED EMBODIMENTS

Figure 1:
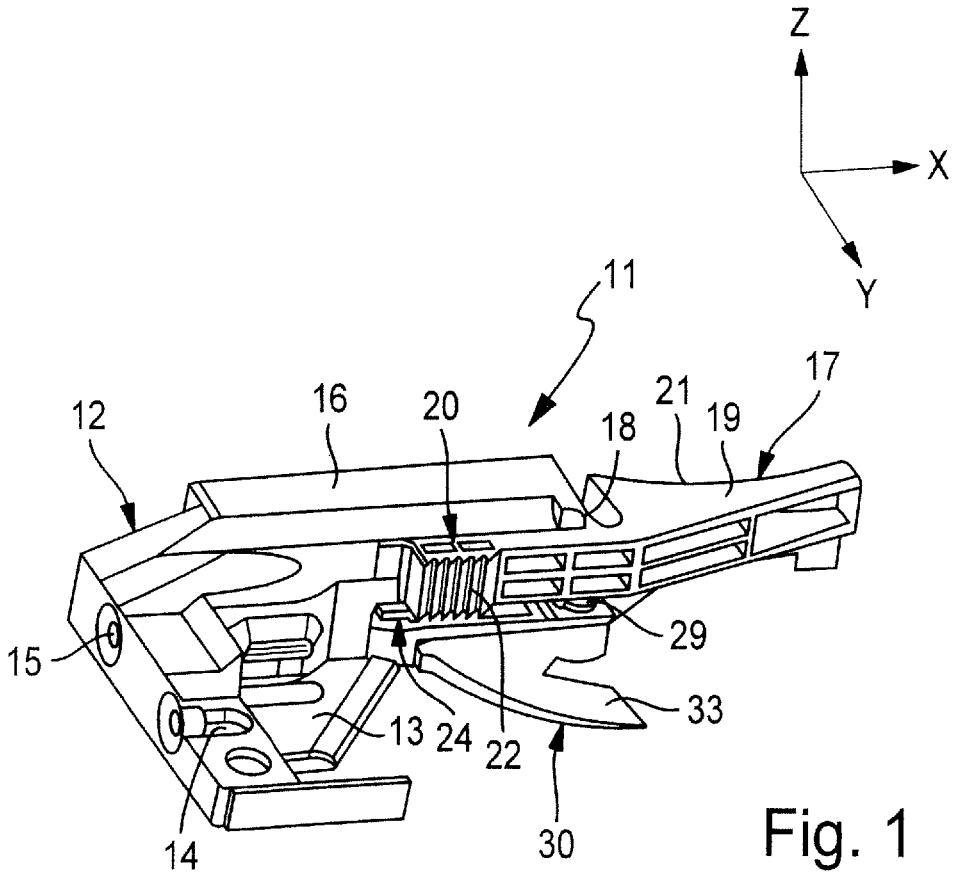
FIG. 1 is a perspective view of a preferred embodiment of the device according to the invention.
Figure 2:
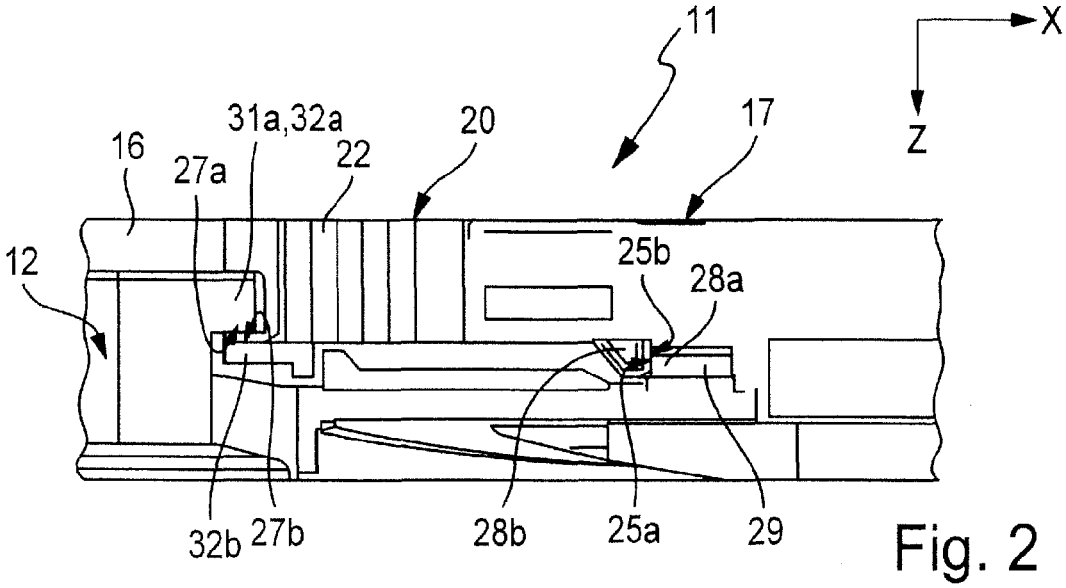
FIG. 2 is a side view of a part of the device from FIG. 1.
Figure 3:
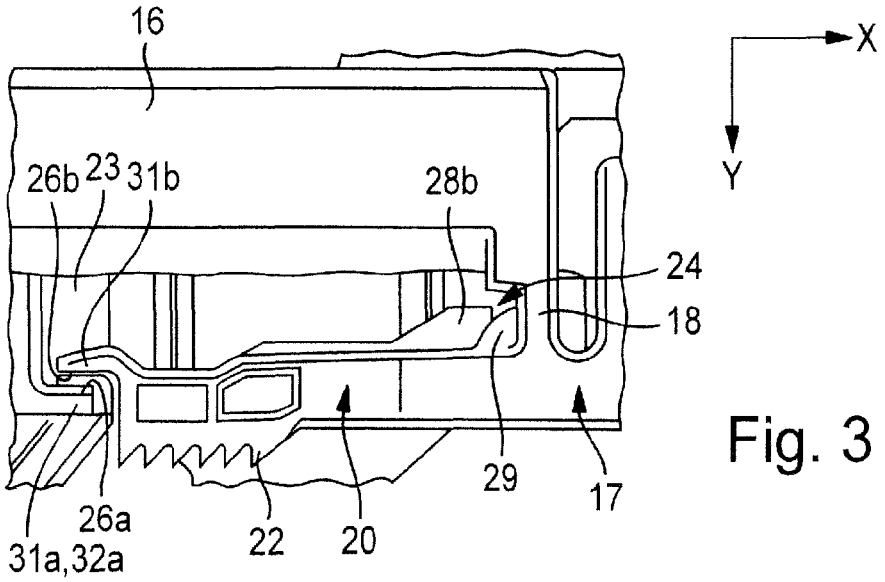
FIG. 3 is a top view of a part of the device from FIG. 1.

FIGS. 1 to 3 show a preferred embodiment of the device 11 according to the invention designed for releasably connecting a furniture pullout part movably guided in a furniture carcass by means of a guide unit to the guide unit.

The device is explained below using a furniture pullout part designed as a drawer as an example.

The drawer is mounted for displacement relative to the furniture carcass via the at least one guide unit. Expediently, several guide units are provided, to which are assigned two opposite lateral edges of the drawer. The guide units may be parts of a so-called underfloor guide, in which the guide units are assigned to the drawer base. Alternatively, the guide units could be integrated into the side wall or the frame of the drawer. The device 11 according to the invention serves as a connecting link between the guide unit and the drawer. For this reason, the device 11 could be called a coupling.

The device 11 comprises a device housing 12 which is made of a plastic material and expediently produced in an injection moulding process. The device housing 12 has a base plate 13 with guide openings 14 for securing to the base of a drawer by means of suitable fasteners, for example screws. The end face of the base plate 13 is wider than the rest of the base plate 13, with through-holes 15 for mounting on a side wall projecting downwards or on the front plate of the drawer being provided on the end face, which is substantially perpendicular to the base plate. A bearing section 16 of an oblong shape rises above the base plate 13 of the device housing 12.

A further part of the device 11 is a lever-type control element 17 which is integrally formed on the bearing section 16 of the device housing 12 via at least one solid body joint 18. This control element 17 is likewise made of a plastic material and injection-moulded to the device housing 12 in the production process. The control element 17 is preferably made of the same plastic material, which makes for low production costs, because a one-component injection moulding process can be used.

The control element 17 is pivotably mounted on the bearing section 16 by way of the solid body joint 18. The control element 17 has a manually operated operating section 19 designed in the manner of a handle. The operating section 19 is located on one side of the solid body joint, with an engagement section 20 provided on the other side for engagement with complementary engagement means (not shown) on the guide unit.

As FIG. 1 in particular shows, the handle-like operating section 19 is wedge-shaped, with a suitable, possibly curved, operating surface 21 being provided on the outside of the operating section 19 for applying a finger of the user. As FIG. 3 in particular shows, the engagement section 20 is provided with latching means in the form of latching teeth 22 on the other side of the solid body joint 18. In the position of the control element 17 shown in FIG. 1, the latching teeth 22 on the engagement section 20 are in engagement with complementary latching teeth (not shown) on the guide unit, thereby coupling the drawer to the guide unit. By the pressure applied by the finger of the user to the operating surface 21, the control element 17 can be pivoted clockwise about the solid body joint 18, and in this process the engagement section 20 with the latching teeth 22 pivots anticlockwise towards the bearing section 16 of the device housing 12, thereby disengaging latching teeth on the control element 17 from the complementary latching teeth on the guide unit.

As FIG. 3 in particular shows, a pivoting recess 23 is formed on the device housing 12, allowing a certain degree of pivoting of the engagement section 20 with the latching teeth 22 towards the bearing section 16. The device 11 further comprises supporting means 24 located at a distance from the solid body joint. The supporting means 24 are designed such that support is provided in the X and Y spatial directions as well as the Z spatial direction of a Cartesian coordinate system defined by X, Y and Z coordinates. For this purpose, complementary supporting surfaces 25*a*, 25*b*, 26*a*, 26*b*, 27*a*, 27*b* are provided on the device housing 12 on the one hand and on the control element 17 on the other hand for supporting the control element against forces acting in the X, Y and Z spatial directions. The supporting surfaces 25*a*-27*b* are formed on supporting projections which project from the periphery of the control element 17 and from the periphery of the device housing 12. Among the supporting projections, there are provided X supporting projections 28*a*, 28*b* with the supporting surfaces 25*a*, 25*b* against forces acting in the X direction. The X supporting projection 28*a* on the device housing is represented by a journal pin 29 of an adjusting member 30 of an adjusting unit for the vertical adjustment of the furniture pullout part, which will be described in greater detail below. The associated supporting surface 25*a* is located on the peripheral surface of the journal pin 29. To complement this arrangement, the X supporting projection 28*b* of the control element is located on the underside of the control element 17 and projects therefrom. The associated supporting surface 25*b* is the surface of the X supporting projection 28*b* which faces the supporting surface 25*a* on the journal pin 29.

The Y supporting projections 31*a*, 31*b* are represented on the side of the device housing 12 by a web section extending in the X direction and forming a boundary of the pivoting recess 23, while the complementary Y supporting projection 31*b* on the control element 17 is represented by an extension of the end face of the engagement section 20, which likewise extends in the X direction. The associated supporting surfaces 26*a*, 26*b* are represented by facing inner surfaces of the supporting projections 31*a*, 31*b*. As FIG. 3 in particular shows, there is only a very small, if any, distance between the two supporting surfaces 26*a*, 26*b* (they may even be in contact with one another), so that, if forces act in the Y direction, the two supporting surfaces 26*a*, 26*b* prevent a relative movement between the control element 17 and the device housing 12 in the Y direction by being in contact with one another.

The Z supporting projections 32*a*, 32*b* are in particular recognisable in FIG. 2. The Z supporting projection 32*a* on the device housing is represented by the same web section which was previously described as Y supporting projection 31*a*. The supporting surface 27*a* is located on the underside of this Z supporting projection 32*a*. The Z supporting projection 32*b* on the control element 17 is represented by a further nose-like extension of the engagement section 20 of the control element 17. The supporting surface 27*b* is located on the top of this Z supporting projection 32*b*.

As a whole, these X, Y and Z supporting projections are produced integrally by a suitable design of the mould in the production of the device 11.

The device 11 further comprises an adjusting unit for the vertical adjustment of the furniture pullout part relative to the guide unit. For this purpose, the adjusting unit comprises a wedge-shaped adjusting member 30, which projects into the gap between the underside of the furniture pullout part and the guide unit and which is pivotably mounted on the device housing 12 by means of the journal pin 29. When the adjusting member 30 is pivoted, a more or less wide or thick region of a wedge-shaped guide section 33 of the adjusting member enters the gap between the guide unit and the underside of the drawer, allowing a vertical adjustment of the drawer relative to the guide unit and thus to the furniture carcass.

The invention claimed is:

1. A device for releasably connecting a furniture pullout part movably guided in a furniture carcass by means of a guide unit to the guide unit, the device comprising a device housing on which a control element is integrally formed and pivotably mounted via at least one solid body joint in such a way that the connection between the furniture pullout part and the guide unit can be released on actuation of the control element, wherein, at a distance from the solid body joint, supporting means are provided for supporting the control element while preventing a relative movement between the control element and the device housing, wherein the supporting means supports the control element in the X, Y and Z spatial directions of a Cartesian coordinate system defined by X, Y and Z coordinates, and wherein the supporting means comprises:

an X supporting projection projecting from the periphery of the device housing and having an X supporting surface facing in the X direction;

an X supporting projection projecting from the periphery of the control element and having an X supporting surface facing the X supporting surface of the device housing for preventing relative movement between the device housing and the control element in the X direction;

a Y supporting projection projecting from the periphery of the device housing and having a Y supporting surface facing in the Y direction;

a Y supporting projection projecting from the periphery of the control element and having a Y supporting surface facing the Y supporting surface of the device housing for preventing relative movement between the device housing and the control element in the Y direction;

a Z supporting projection projecting from the periphery of the device housing and having a Z supporting surface facing in the Z direction; and a Z supporting projection projecting from the periphery of the control element and having a Z supporting surface facing the Z supporting surface of the device housing for preventing relative movement between the device housing and the control element in the Z direction.

2. A device according to claim 1, wherein the control element is designed in the manner of a lever, with a manually operated operating section, which is located on the near side of the solid body joint, and with an engagement section for engagement with the complementary engagement means on the guide unit, which is located on the other side of the solid body joint.

3. A device according to claim 2, wherein the engagement section comprises latching teeth, which can be latched to complementary engagement means likewise designed as latching teeth.

4. A device according to claim 1, further comprising an adjusting unit for the vertical adjustment of the furniture pullout part relative to the guide unit.

5. A device according to claim 4, wherein the adjusting unit comprises a wedge-shaped adjusting member which projects into the gap between the underside of the furniture pullout part and the guide unit and the adjusting movement of which causes a raising or lowering of the furniture pullout part relative to the guide unit.

6. A device according to claim 5, wherein the adjusting member is pivotably mounted on the device housing by way of a pivot bearing having a journal pin.

7. A device according to claim 6, wherein the journal pin is a part of the supporting means for the control element.

8. A device according to claim 1, wherein the device housing and the control element are made of the same plastic material.

9. A device according to claim 8, wherein the device housing and the control element are injection-molded plastic parts, the control element being injection-molded to the device housing in the production process.

10. A piece of furniture with a furniture pullout part which is movable relative to a furniture carcass and guided by way of a guide unit, wherein the piece of furniture comprises a device according to claim 1.

* * * * *